US011325084B2

(12) United States Patent
Cooner

(10) Patent No.: US 11,325,084 B2
(45) **Date of Patent: *May 10, 2022**

(54) DUST SHIELD DEVICE

(71) Applicant: Charles C. Cooner, Janesville, WI (US)

(72) Inventor: Charles C. Cooner, Janesville, WI (US)

( * ) Notice: Subject to any disclaimer, the term of this patent is extended or adjusted under 35 U.S.C. 154(b) by 590 days.

This patent is subject to a terminal disclaimer.

(21) Appl. No.: 16/244,264

(22) Filed: Jan. 10, 2019

(65) Prior Publication Data

US 2020/0222869 A1 Jul. 16, 2020

(51) Int. Cl.

| | |
|---|---|
| ***B01F 15/00*** | (2006.01) |
| ***B01F 35/00*** | (2022.01) |
| *B01F 33/501* | (2022.01) |
| *B01F 101/28* | (2022.01) |

(52) U.S. Cl.

CPC ..... *B01F 35/186* (2022.01); *B01F 35/189* (2022.01); *B01F 33/5011* (2022.01); *B01F 2101/28* (2022.01)

(58) Field of Classification Search

CPC ..... B01F 15/00961; B01F 15/00967; B01F 15/00974; B01F 15/00993; B01F 2215/0047; B08B 15/04; B08B 15/007; E03D 9/052; B01D 46/0041

USPC ..... 366/347

See application file for complete search history.

(56) References Cited

U.S. PATENT DOCUMENTS

| | | | | |
|---|---|---|---|---|
| 3,673,744 | A | 7/1972 | Oimoen | |
| 4,071,338 | A * | 1/1978 | Hutter, III | B08B 15/007 96/139 |
| 4,621,462 | A | 11/1986 | Hinshaw | |
| 4,780,143 | A | 10/1988 | Roe | |
| 5,411,433 | A | 5/1995 | Keller | |
| 5,414,892 | A | 5/1995 | Clark, Jr. | |
| 7,297,188 | B2 | 11/2007 | Nielsen | |
| 8,348,726 | B2 | 1/2013 | Brunner | |
| 9,168,624 | B2 | 10/2015 | Hahn | |
| 9,296,079 | B2 | 3/2016 | Miwa | |
| 9,656,361 | B2 | 5/2017 | Appel | |

(Continued)

OTHER PUBLICATIONS

Contractors Direct website printout showing Beaton Innovations, LLC's WaleTale Dust Containment Vacuum Attachment sold since at least as early as 2017.

*Primary Examiner* — Elizabeth Insler

(74) *Attorney, Agent, or Firm* — Jeffrey S. Sokol

(57) ABSTRACT

The present invention is a dust shield device that secures over a mixing pail. Powdery material, such as plaster, cement, grout or the like, is poured through the device, and mixed with water inside the pail. The device includes a mounting sleeve, a radial manifold housing and a funnel shaped lid. The manifold housing and lid form a radial pneumatic channel with a circumferentially disbursed air intake that generates a radially uniform airflow that draws in airborne dust that would otherwise escape to the surrounding air. The manifold is connected to a vacuum with an air filter, and generates a dust shield zone and air intake zone above the device. The manifold lid forms a radial guard to prevent downward flows of material and water from entering the manifold, and forms a splash guard to retain upwardly projected splashes of material and water inside the pail.

22 Claims, 7 Drawing Sheets

(56) References Cited

U.S. PATENT DOCUMENTS

| | | | |
|---|---|---|---|
| 9,821,389 | B2 | 11/2017 | Buser |
| 10,016,868 | B2 | 7/2018 | Sheldon |

* cited by examiner

DUST SHIELD DEVICE

TECHNICAL FIELD OF THE INVENTION

This invention relates to a dust shield device that fits over a mixing pail, allows a powdery material and water to pour through its open interior and into the pail, forms a radial manifold with a circumferentially disbursed air intake that generates a substantially uniform airflow to draw in airborne dust that would otherwise escape to the surrounding air, allows dust below the air intake to settle onto the surface of the mixture inside the pail, forms a radial baffle to retain splashes of material and water during mixing, and increases the effective diameter of the pail to funnel material, water and splashes into the pail.

BACKGROUND OF THE INVENTION

A variety of building construction materials are sold in powder or granular form for mixing with water prior to use. Plaster, grout, cement and drywall joint compound are examples of these products. Once mixed, the material is quickly applied before it begins to cure. The products are mixed at the job site, which is often inside a house or building. Pouring these products into a mixing pail and mixing them with water is messy and generates dust that propagates into the surrounding air. Pouring the material generates dust above the mixing pail, as well as dust that rises out of pail. Mixing the powdery material with water generates additional dust that rises out of the pail. Water and powdery material also splash out of the pail and onto the worker, their clothing and the floor. Dust and residue that accumulates inside a building is blown or kicked back up into the air by other construction activities. Workers breathe the dust, which irritates their respiratory systems. The long term effects of regularly inhaling this dust include occupational asthma and chronic obstructive pulmonary disease.

Minimizing the proliferation of dust and splashes of material and water while meeting the rigors of construction is difficult. The pouring and mixing steps are typically done as quickly as possible, which invariably produces dust and splashes, particularly when power mixing tools are used. While masks should be worn, their use is inconvenient and often ignored. Workers frequently fail to take the time to locate and put on a mask, particularly when they are wearing gloves and a hat. Cleaning the area around the mixing pail is also inconvenient and often ignored. Workers walk through, sit in or brush against residue, and track or carry it throughout the building.

Conventional products are used to reduce dust when pouring and mixing a powdery material. One such product is sold by Beaton Innovations as the WALE TALE vacuum attachment. These conventional products suffer from a variety of problems. For example, the vacuum attachment has a suction inlet with a securement slot that attaches to the rim on one side of the mixing pail. The attachment draws air and dust directly toward that side of the pail. The suction inlet is located at and inward of the pail rim. This arrangement suffers from several problems. While dust closer to the attachment side of the pail may be captured, dust on the opposite side of the pail more readily escapes into the surrounding air. Turning up the vacuum suction and air flow only accentuates the other following problems.

Vacuum attachments needlessly consume the powdery material. First, mixing pails are relatively narrow in diameter, and powdery materials spreads out when being poured through the air. Large amounts of material are consumed when material is poured along a flow path passing near the intake of the attachment. Directing the pour away from the attachment results in some of the powdery flow missing the pail. Any slip or inattention by a worker pouring a heavy bag of powdery material sends a large quantity of powdery material to the vacuum or onto the floor. Second, not all of the dust generated during pouring and mixing the powdery material needs to be filtered by the vacuum. A significant amount of dust remains inside the mixing pail, and if allowed, will settle onto the surface of the mixture being prepared. Yet, conventional vacuum attachments draw in dust from inside the pail. Third, conventional vacuum attachments produce air flow patterns that disturb the surface of the mixture inside the pail, particularly when larger batches are being prepared. This surface disturbance generates additional dust. The vacuum attachment then consumes that additional, self-generated dust. Fourth, water can be inadvertently poured into the intake vent of the vacuum attachment, particularly when a worker is tired, rushed, distracted or not properly trained. The resulting water and material mixture inside the vacuum cures and clogs the vacuum and its air filter. Fifth, the vacuum attachment has a relatively wide, and exposed suction intake that consumes splashes of material and water during mixing. Again, this material and water mixture clogs the vacuum and its air filter. The needless consumption of material and inadvertent consumption of water results in extra work and down time. Workers have to frequently open and clean the interior of the vacuum and its air filter, particularly when water is consumed. Allowing the mixture to cure inside the vacuum clogs and destroys the vacuum and its air filter.

Conventional dust reduction products do not prevent splashes of material and water from escaping the pail during the mixing process. Power tools equipped with mixing paddles propel splashes out of the pail, which creates a significant mess, particularly when larger batches come close to filling the pail.

Conventional dust reduction products do not facilitate pouring a powdery material into a mixing pail. Mixing pails have a relatively small diameter. Workers have to pick up and manipulate a heavy container or bag of powdery material while bending over a mixing pail so the flow of material is close to the top of the pail. Some of the powdery material invariably misses the pail and lands of the floor or their shoes, and is tracked around the building.

The present invention is intended to solve these and other problems.

BRIEF DESCRIPTION OF THE INVENTION

The present invention relates to a dust shield device that secures over a mixing pail. Powdery material, such as plaster, cement, grout or the like, is poured through the device, and mixed with water inside the pail. The device includes a frustoconical mounting sleeve, a radial manifold housing and a funnel shaped lid. The sleeve extends the height of a mixing pail. The manifold housing and lid expand the effective diameter of the pail, and form a radial pneumatic channel with a circumferentially disbursed air intake that generates a radially uniform airflow that draws in airborne dust that would otherwise escape to the surrounding air. The manifold is connected to a vacuum with an air filter, and generates a dust shield zone and air intake zone above the device. The manifold lid forms a radial guard to prevent downward flows of material and water from entering the manifold, and forms a splash guard to retain upwardly projected splashes of material and water inside the pail.

The present dust shield device enhances worker safety by capturing airborne dust that would otherwise escape to the surrounding air. The frustoconical base positions the radial manifold above the top rim of the mixing pail. The air intake is circumferentially disbursed around the manifold to form a dust shield zone and dust intake zone above and around the pail. In the preferred embodiment, the air intake is formed by uniformly spaced suction ports and hooded intake vents. Dust rising up from the pail and into the vicinity of the manifold is effectively captured by the suction ports with hooded intake vents, and directed by the radial manifold to the filtered vacuum. The suction ports and vents also draw in airborne dust above the device. When pouring the powdery material, airborne dust is effectively drawn into the manifold from a height of about one half to one foot above the device.

The present device enhances productivity by avoiding unnecessary consumption of powdery material and dust during the pouring and mixing steps. First, the frustoconical base extends the height of the mixing pail so that more material and dust is retained. Denser flows of powdery material and heavy dust are allowed to settle inside the mixing pail. Second, the device uniformly draws in airborne dust above and around the circumference of the mixing pail. This circumferentially disbursed radial air intake produces an air flow pattern that draws in dust axially and downwardly toward the radial manifold. The device does not draw in material and heavier dust from inside the mixing pail. Powdery material on the surface of the mixture inside the pail is not disturbed and heavier dust inside the pail is allowed to settle. Third, the funnel-shaped lid directs water and material pouring or flowing down into the mixing pail away from its suction ports and hooded intake vents. The lid has arced portions above the vents and flat sloped portions between them. Water and material landing on arced portions of the lid are direct to the sides of the intake vents and do not flow directly over the front of the vents. Fourth, the hooded intake vents are bottomless so that heavier material and dust flows and water drop down into the container and are not readily drawn into the suction ports. While the vents draw in lighter airborne dust floating near the manifold air intake level, denser flows of water, material and dust fall by gravity down into the pail instead of entering the suction ports. By reducing the unnecessary and undesired intake of material flows, heavier dust and water into the device, both worker productivity and safety are enhanced.

The present dust shield device forms a splash guard that prevents splashes of material and water from escaping during the mixing process. The lower mounting base portion of the device increases the effective height of the mixing pail. This reduces the amount of splashes that would otherwise escape over the top rim of the pail, even when a worker is making a large batch of material that fills or comes close to filling the pail. The upper portion of the device also has a radial baffle or splash guard formed by an inwardly extending portion of the lid. Splashes reaching the upper portion of the device are redirected back into the pail. Any splashes landing on the top of the funnel-shaped lid flow, or are easily brushed, back into the container.

The present dust shield device is quickly installed and removed. The frustoconical mounting base is flushly received by and secured to the sidewall of the mixing pail. A vacuum hose is easily connected to its exit port. Powdery material and water are poured through the device and into the mixing pail. The device remains installed on the pail during both the pouring and mixing processes. Mixing paddles are inserted through the device and into the pail. Additional water and material are also readily poured through the device to achieve a desired material consistency. When pouring and mixing are complete, the device is readily lifted off the pail and placed aside for further use. The device is easily cleaned by spraying water over its surfaces. The manifold lid is easily removed to expose and clean its internal channel, suction ports, intake vents and exit nozzle. There are no electrical components to short or moving parts to clog or jam.

The present dust shield device prevents spills of powdery material during the pouring process. The funnel-shaped lid extends outwardly from the generally vertical sidewall of the mixing pail to give a worker a larger effective area into which to pour the powdery material and water. The inwardly and downwardly sloped lid directs the powdery material and water into the mixing pail. Any powdery material remaining on the lid is readily brushed into the container.

The present dust shield device accommodates a variety of mixing containers. The tapered nature of the frustoconical base is received by containers with varying diameters. The device fits five and seven gallon containers. This versatility helps ensure that workers can mix the right amount of material for the particular job at hand.

Other aspects and advantages of the invention will become apparent upon making reference to the specification, claims and drawings.

DESCRIPTION OF THE PREFERRED EMBODIMENT

Figure 1A:
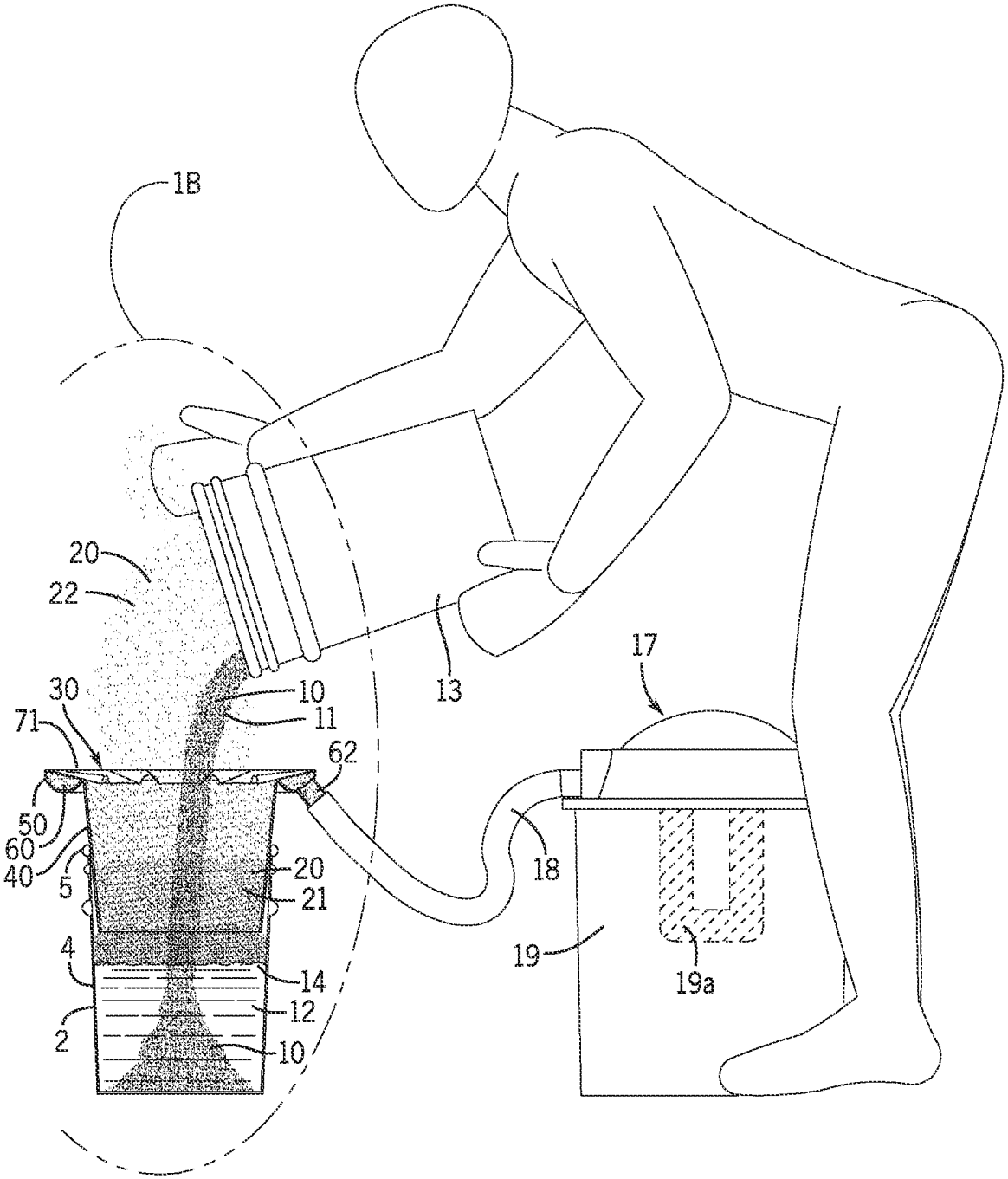
FIG. 1A is a perspective view of the dust reduction and splash guard device installed on a mixing pail partially filled with water and a worker pouring a powdery material through the central opening of the device and into the pail, with the device capturing the dust generated by the process of pouring the powdery material through the air and into the pail.

While this invention is susceptible to embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

The present invention pertains to a dust reduction and splash guard device placed on a conventional mixing pail 2 to facilitate the pouring and mixing of a powdery material 10 and water 12 inside the pail to form a construction material, such as plaster, grout, cement or dry wall joint compound. The cylindrical mixing container or pail 2 has a flat bottom 3, tubular sidewall 4, circular top rim 5, smooth inside surface 6, open interior 8 and central axis 9. The sidewall 4 is cylindrical and generally normal to the bottom 3, but can be slightly tapered and narrower at the bottom for stacking purposes. The container 2 is typically a conventional five to seven gallon pail made of high density polyethylene (HDPE) with a height of about 14 to 21 inches, top inside diameter of about 10.5 to 12.75 inches, and wall thickness of about ⅛ inch. The outside surface can include one or more outwardly extending gripping ribs near the top rim 5. The bottom 3 of the pail 3 lays flat on a generally horizontal supporting surface during use.

Figure 5:
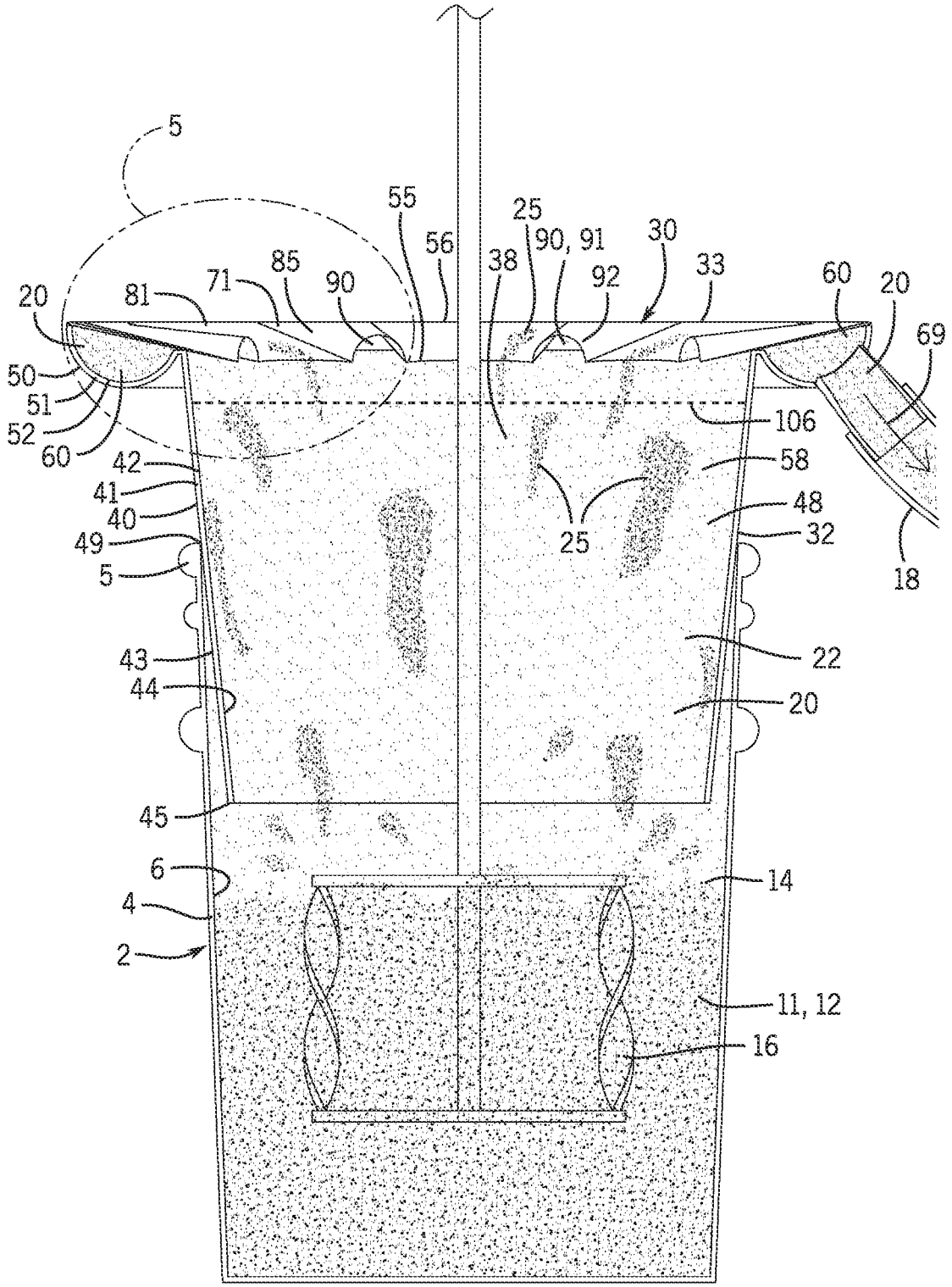
FIG. 5 is a side sectional view of the device placed on a mixing pail containing powdery material and water, with rotating mixing paddles generating dust that is vented to the vacuum, and showing splashes of material and water that that fly around inside the container and strike or land on the radial baffle or lid of the device and are redirected back into the pail.

The powdery material 10 is poured from its package 13 into the pail 2 and mixed with a liquid solvent 12 such as water. Material 10 and water 12 are poured into the pail 2 until the surface level 14 of the mixture reaches a desired height. Mixing is typically done with a conventional power tool 15, particularly for larger construction jobs, but can be done by hand. The power tool 15 is commonly a 5 to 10 amp power hand drill equipped with mixing paddles 16. Suction generating equipment 17 is used to create a lower than atmospheric pressure condition or vacuum that draws in unwanted dust 20. The vacuum equipment 17 is preferably a conventional 8 to 12 amp, 50 to 250 cfm, wet-dry vacuum with a standard 2.5 inch diameter suction hose 18 and 5 to 20 gallon bucket 19 with an internal filter 19*a*. The hose 18 has a cross-sectional area of about five square inches. Pouring the powdery material 10 generates dust 20 as shown in FIGS. 1 and 1B. Dust 20 is generated as the powdery material 10 flows 11 out of its shipping package 13 and through the air. The powdery flow of material 11 is thicker or denser near its center and tends to thin or lighten as it spreads out axially from that center. Dust 20 is also generated as the flow 11 of material 10 strikes the bottom 3 of the mixing pail 2 or surface 14 of the mixture inside the pail. Thicker and heavier dust 21 tends to remain below the top rim 5 of the pail 2, and, if allowed, eventually settles down onto the mixture surface 14. When the present device is not used, unwanted airborne dust 22 is generated above the pail 2 or floats up into the surrounding air above the pail 2. This unwanted airborne dust 22 is less dense or lighter than the main flow of material 11 and denser dust 21 that will settle inside the pail 2. Mixing the powdery material 10 with liquid water 12 also generates dust 20 as shown in FIG. 5. Denser concentrations of dust 21 remain inside the mixing pail 2, while unwanted airborne dust 22 is propelled up or floats up into the surrounding air outside the pail. The mixing process also generate splashes 25 of material 10 and water 12 that fly around in the mixing pail 2. Some splashes 25 clear the top rim 5 of the pail 2.

The present invention pertains to a multipurpose dust shield and splash guard device shown generally by reference number 30 in FIGS. 1-6. The device 30 has lower and upper portions 32 and 33 that form an open interior 38 with a central axis 39. As discussed below, the lower portion 32 includes a mounting sleeve 41. The upper portion 33 includes a radial manifold housing 51 and funnel-shaped lid 71. The components forming the device 30 are preferably made of plastic, such as high density polyethylene (HDPE) or ABS. As discussed below and shown in FIGS. 1A and 1B, the device 30 extends the height of the mixing pail 2, and forms a radial channel 60, radially disbursed air intake 90 and a radial splash guard 110 above the pail rim 5. When placed on the pail 2 and drawing suction from the vacuum 17, the device 30 generates a dust shield 105 and dust intake zone 109 above and around the pail and device as in FIGS. 1B, 2 and 3.

Figure 3:
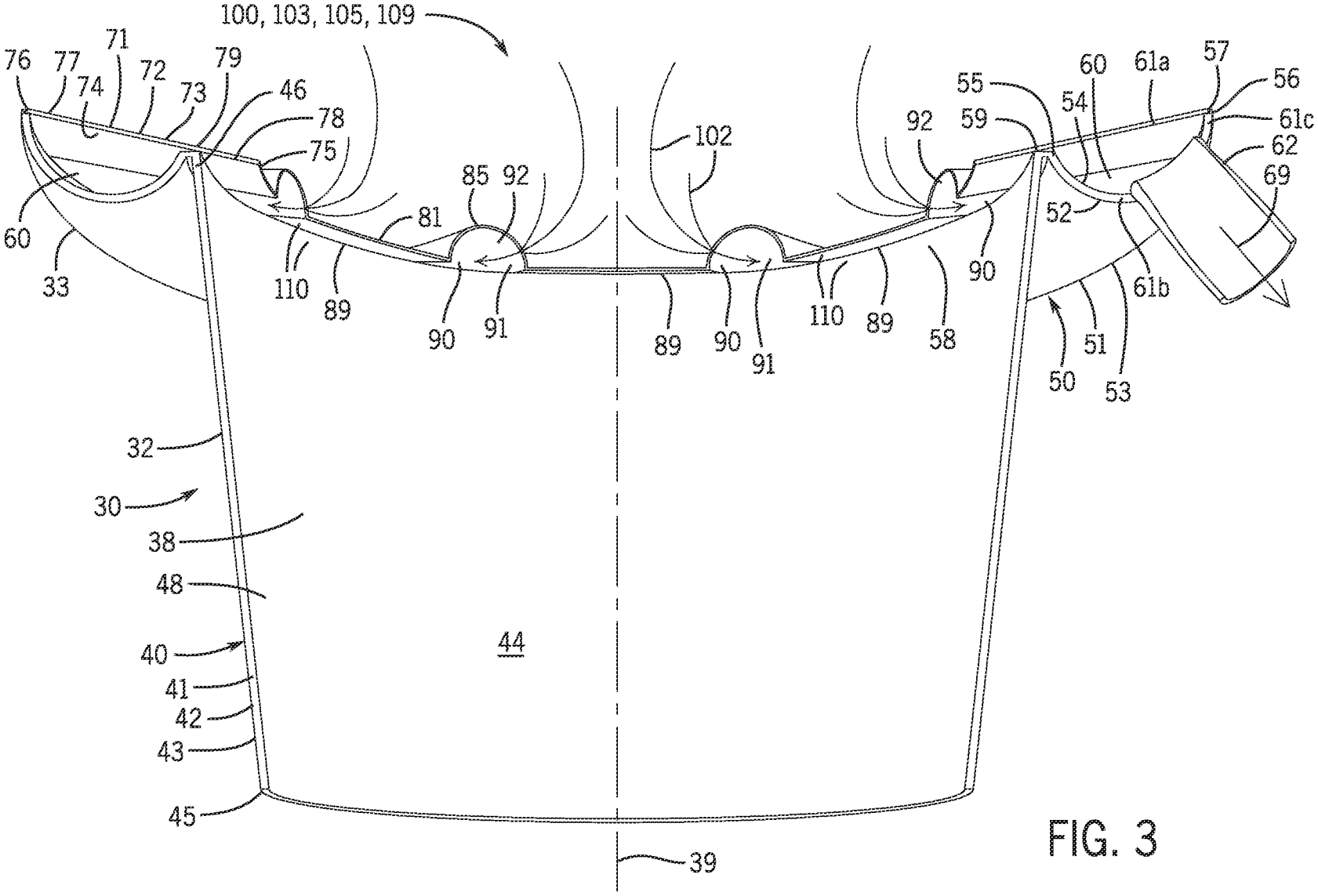
FIG. 3 is a sectional view of the device showing the underside of the lid and the side wall forming the hooded intake vents and suction ports, and showing the air flow paths over the central opening and into and through its vents and ports.
Figure 4:
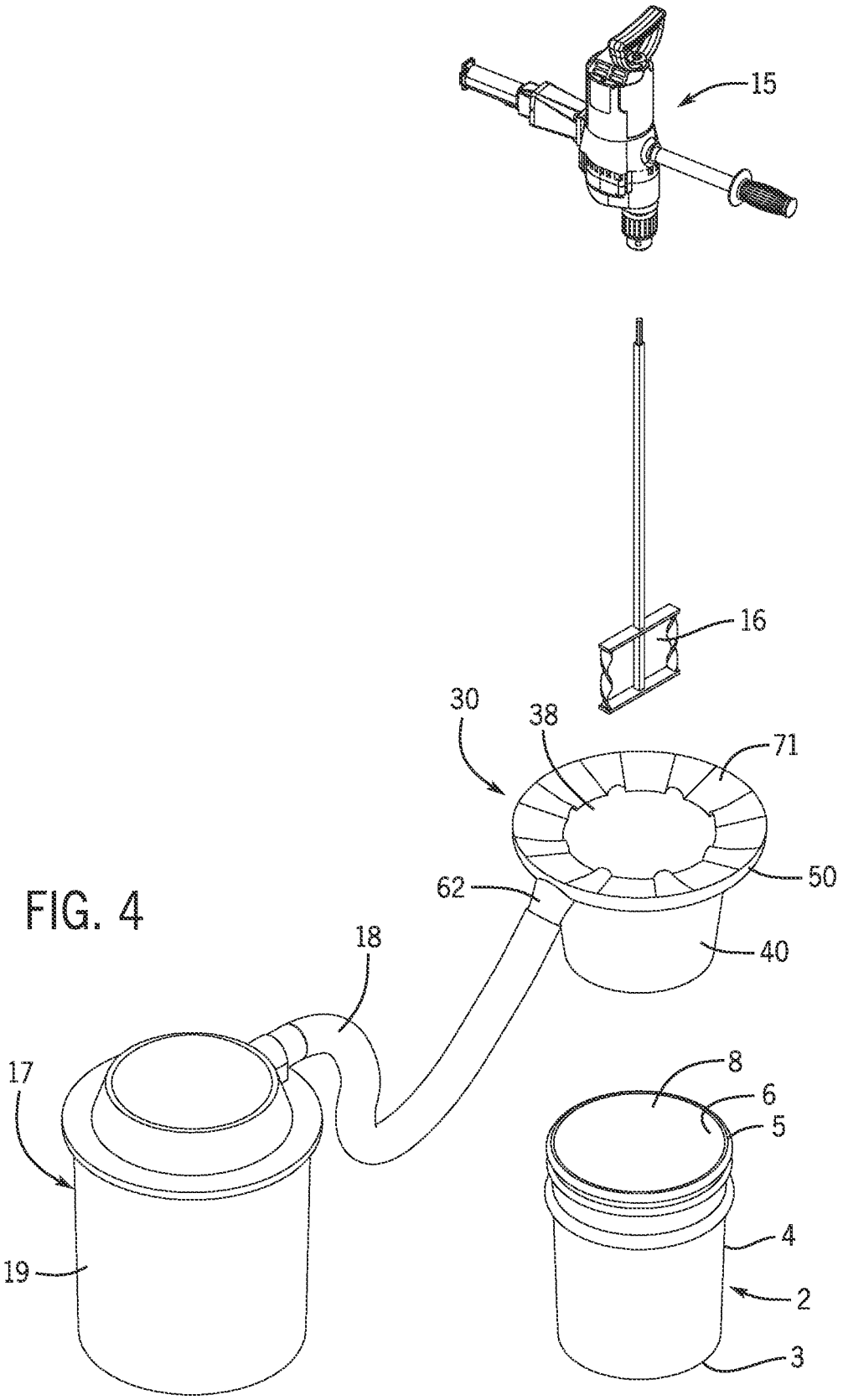
FIG. 4 is an exploded view of the device, mixing pail, vacuum, power tool and mixing paddles.

The lower portion 32 of the device 30 includes a base or mounting structure 40 having a sleeve 41 formed by a frustoconical sidewall 42 as best shown in FIG. 3. The tapered sidewall 42 is preferably solid and continuous through 360 degrees, and has a degree of flexibility to accommodate a releasable snug fit with the sidewall 4 of the pail 2. The tapered sidewall 42 has inner and outer surfaces 43 and 44, and open lower and upper ends 45 and 46 that form the upper and lower radial perimeters of the frustoconical sleeve 41. The sleeve 41 is tapered with the radial lower end 45 being narrower than the radial upper end 46. The sidewall 42 defines circular openings at its upper and lower ends 45 and 46, and an open tapering interior 48. The outside surface 43 of the base 40 is snuggly received by and seals against the inside surface 6 of the pail 2 to form a seal 49. The seal 49 prevents air from flowing into the pail 2 from between the pail and base 40 during use. The seal 49 also prevents material 10, water 12, dust 20 and splashes 25 from escaping out from between the pail 2 and base 40. The central axes 9 and 39 of the pail 2 and device 30 are colinear during use.

The tapered mounting sleeve 41 is inserted in and secured to the mixing pail 2. The weight of the device 30 is supported by the pail 2, which helps form the seal 49 between them. The sleeve 41 is shaped to accommodate a variety of conventional five to seven gallon pails 2. The diameter of the upper base end 45 is larger than the diameter of the upper pail rim 5. The base 40 shares common central axis 39. The sidewall 42 preferably has a length of about 11 inches, and cross sectional thickness of about ⅛ inch. The lower and upper ends 45 and 46 have diameters of about 10 inches and 13 inches, respectively. The flow 11 of powdery material 10 is poured through the open interior 38 of the device 30. The inside surface 44 of the base sidewall 42 is smooth and free of obstructions to allow material 10, water 12 and splashes 25 to flow down into the container 2. The smooth inside surface 44 also avoids binding contact with the rotating mixing tool 15 during use.

The upper portion 33 of the device 30 includes the radial manifold 50. The radial or ring manifold 50 is formed by a manifold housing 51 and a manifold lid 71. The ring manifold 50 extends radially outwardly from the top 46 of the mounting sleeve 41 and outwardly from the upper rim 5 of the mixing pail 2. The ring manifold 50 has an outer diameter of about 18 inches. The radial manifold 50 also shares common axis 39. The manifold housing 51 has a curved radial wall 52. This radial wall 52 is preferably integrally formed with the base wall 42. The radial wall 52 has a uniform thickness and a cross-sectional bowl shape that resembles the bottom half of a donut as best shown in FIG. 3.

The radial manifold wall 52 has lower and upper surfaces 53 and 54, inner and outer radial ends 55 and 56 and an open interior 58. The inner radial end or perimeter 55 is integrally joined to and extends outwardly from the upper radial end or upper perimeter 46 of the base wall 42, and extends completely around the base wall 42 through 360 degrees. The inner radial perimeter 55 of the bowl-shaped manifold wall 52 is integrally and continuously joined to the upper radial end 46 of the frustoconical sleeve 41. Air, material 10, water 12, dust 20 and splashes 25 do not pass between the base 40 and manifold 50. The outer radial end or perimeter 56 of the bowl-shaped manifold wall 52 forms the outer perimeter of the ring manifold 50. The bowl-shaped wall 52 is pitched about fifteen degrees (15°) so its outer radial perimeter 56 is raised higher than its inner radial perimeter 55. An upwardly facing notch 57 is formed into and around the outer radial perimeter 56.

Figure 2:
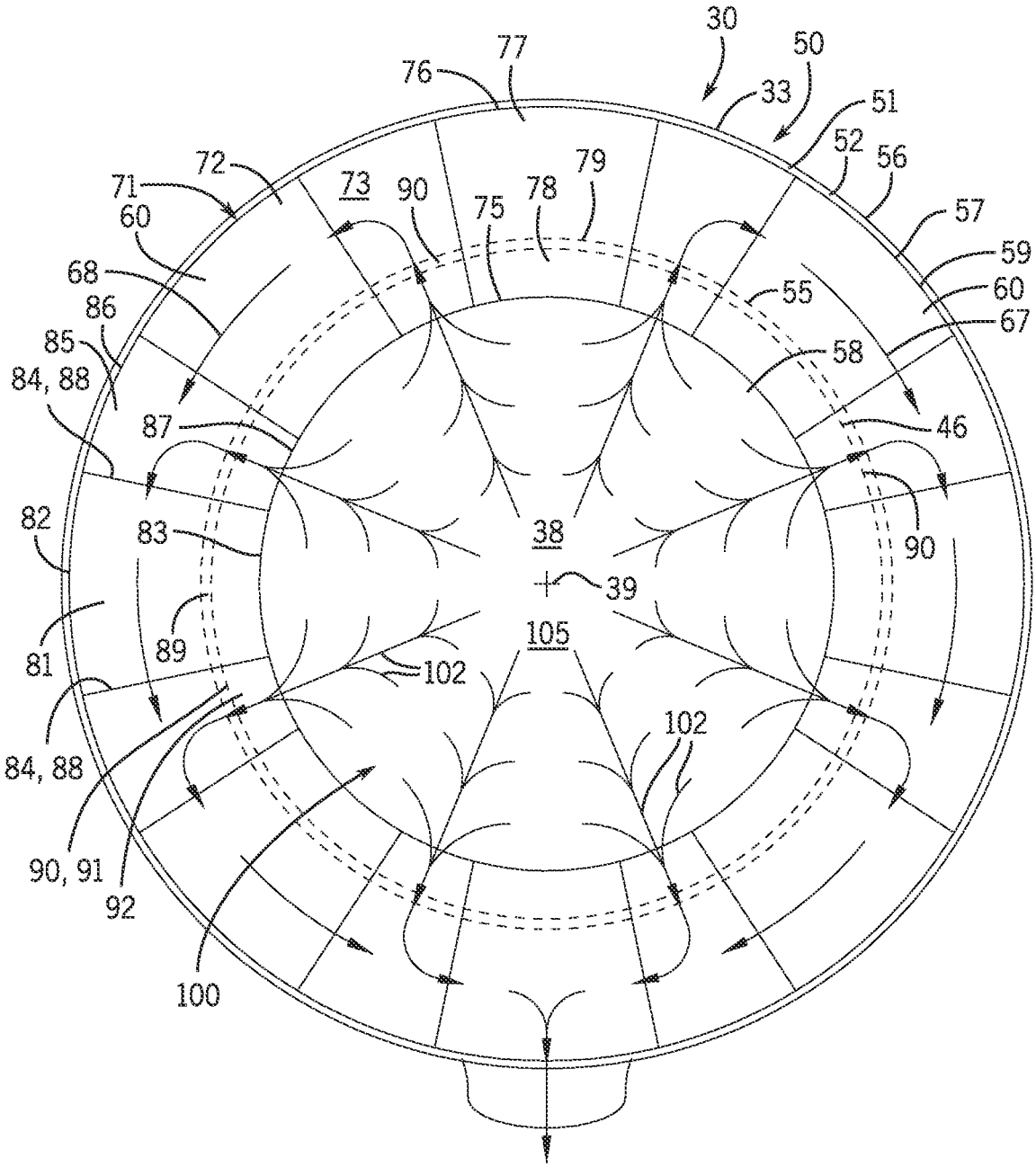
FIG. 2 is a top view of the device showing the air flow paths over its central opening and into and through its hooded intake vents, suction ports, radial chamber and exit nozzle.

The manifold housing 51 forms a channel 60 extending around the upper radial perimeter 46 of the base 40. The channel 60 has a uniform cross-sectional shape around its circumference, and is formed by top, bottom and side manifold surfaces 61*a-c*. One side of the ring manifold 50 has an exit nozzle 62. The channel 60 extends 360 degrees around the base 40 and manifold 50, and is in pneumatic communication with and feeds to the exit nozzle 62. The exit or discharge nozzle 62 has an outer end or port 63 forming an exit opening. The exit port 63 is sized to accommodate a snug and sealed fit with the vacuum hose 18. The vacuum hose 18 is connected to the exit nozzle 62 so that the channel 60 is in pneumatic communication with the suction force of the vacuum 17. As shown in FIG. 2, air is suctioned from the entire channel 60 through the exit nozzle 62 and into the vacuum hose 18. One half or side of the radial channel 60 feeds air along a first path 67 to the exit nozzle 62, and the other half or side of the channel feeds air along a second path 68. The flow paths 67 and 68 merge into a common air flow path 69 at the exit nozzle 62, which flows through vacuum hose 18 to vacuum 17 and its air filter 19*a*.

The manifold lid 71 is funnel-shaped and preferably takes the form of a disc or cover plate 72. The lid 71 is placed over and received by the manifold housing 51 to form the top 61*a* of the channel 60. The lid 71 has upper and lower surfaces 73 and 74 and inner and outer radial ends 75 and 76. The outer radial end or perimeter 75 has a diameter of about 17.75 inches, which is slightly smaller than the diameter of the manifold housing outer perimeter 56 so that the lid 71 engages and fits into the radial notch 57 of the manifold housing 51. The lower lid surface 74 continuously engages and rests on the upper surface of the notch 57 around the outer manifold perimeter 56.

The manifold lid 71 has outer and inner portions 77 and 78, and is supported by the manifold housing 51. The outer lid portion 77 forms the top 61*a* of the manifold channel 60. The outer lid portion 77 extends from the outer radial perimeter 76 to a middle radial arc 79 that is aligned over and rests on the inner radial manifold perimeter 55 or upper radial base perimeter 46. The inner lid portion 78 extends from the radial arc 79 to the inner radial perimeter 75. The inner lip portion 78 forms a cantilevered, inwardly extending, disc-shaped, radial lip. The inner lid perimeter 75 preferably extends inwardly about one inch beyond the upper base 46 or inner manifold 55 perimeters. The inner lid perimeter 75 has a smaller diameter of about 10.75 inches.

When the manifold channel 60 draws suction from the vacuum 17, the outer lid portion 78 is pulled down and held against the manifold housing 51. The lid perimeter 76 is pulled down into pressed engagement with the notch 57 of the outer manifold perimeter 56. The radial arc 79 of the lid 71 is pulled down into pressed engagement with the base or manifold perimeters 46 and 55. The outer lid perimeter 76 is in substantially sealed engagement 59 with the outer manifold perimeter 56. As discussed below, the inner lid arc 79 is in periodic sealed engagement 89 with the upper base perimeter 46, the inner manifold perimeter 55, or both.

The manifold lid 71 is an integral piece having a series of altering flat 81 and arched 85 segments as shown in FIGS. 2 and 3. The flat segments 81 have inner, outer and side ends 82-84. The arched segments 85 have inner, outer and side ends 86-88. The sides 88 of the flat segments 81 merge into the sides 88 of the arched segments 85. The outer segment ends 82 and 86 form the continuous flat outer lid perimeter 76, so the lower lid surface 74 continuously seals 59 against the notch 57 of the outer manifold perimeter 56. The inner segment ends 83 and 87 form the periodically undulating inner lid perimeter 75.

The flat and arched segment 81 and 85 are pitched to slope down toward the open interior 38 of the device 30. The flat segments 81 are pitched a first amount of about 15 degrees (15°). The crests of the arched segments 85 are pitched a second amount of about 5 degrees (5°). The differing pitch amounts cause the height of the arched segments to grow in size the closer they are to the inner lid perimeter 75. The width of the arched segments 85 also decrease in size the closer they are to the inner lid perimeter 75. The increasing height and decreasing width of the arched segments 85 cause their degree of arch to be more pronounced along their inner lid ends 87.

The manifold housing 51 and arched lid segments 85 form the radially disbursed air intake 90. The air intake 90 faces inwardly toward the centerline 39 of the device 30, and is dispersed circumferentially around the inner perimeter 55 of the radial manifold 50. The air intake 90 has a total size of about five square inches, which is about the same as the cross-sectional area of the conventional vacuum hose 18. The air intake 90 is preferably formed by spaced suction ports 91 with hooded intake vents 92 dispersed around the inner manifold perimeter 55. In the preferred embodiment, there are eight flat segments 81, eight arched segments 85 and eight suction ports 91. The eight suction ports 91 are preferably uniformly dispersed at 45 degree (45°) increments around the inner manifold perimeter 55. Each port 91 has a semicircular shape with a diameter of about 1.3 inches and an area of about 0.6 square inches. The cumulative or total area of the ports 91 is about five square inches.

The lower surfaces 74 of the flat segments 81 of the radial lid 71 rest on the upper base end 46 and inner manifold end 55. When suction is drawn via the vacuum 17, the manifold lid 71 is drawn down so that the radial lid support location 79 of each flat segment 81 is drawn down into pressed engagement with and forms a seal 89 with the base 41 and manifold housing 51. Material 10, water 12 and splashes 25 do not pass through this seal 89, which forms about sixty-six percent (66%) of the inner circumference of the manifold 50. The lid 71 is sufficiently rigid that the arched segments 82 do not deform and their lower surfaces 74 remain spaced from the upper base end 46 and inner manifold end 55 to form suction ports 91. The suction ports 91 form about thirty-three percent (33%) of the inner circumference of the manifold 50. When the suction force of the vacuum 17 is turned off, the lid 71 is released from pressed engagement with the base wall 42 and manifold housing wall 52, and it is free to be removed for cleaning.

A hooded intake vent 92 is positioned in front of each suction port 91. The hooded vents 92 are formed by the arced segments 85 of the inner portion 78 of the manifold lid 71. The arched segments 85 form the top and side walls of each vent 92. The vents 92 have an open bottom with no bottom wall. The hooded and bottomless vents 92 extend axially inward from the suction ports 91 toward the central axis 39 of the device 30.

The radially distributed air intake 90, such as via suction ports 91 and vents 92, is distributed around the circumference of the inner manifold perimeter 55 to produce a substantially uniform volumetric air intake 100 around the inner perimeter 55 and over the open interior 38 of the device 30 as best shown in FIG. 2. The air flow path of travel 102 for the suction ports 91 and hooded vents 92 extend axially inward toward the centerline 39. The radially uniform air intake 100 and air flow path of travel 102 form a dust shield zone 105 over the top 5 of the pail 2 and the otherwise open interior 38 of the device 30. The radially uniform air intake 100 inhibits air and dust 20 from being draw up from inside 8 the pail 2. The bottom 3 and sidewall 4 of the pail 2 and the sleeve 41 and seal 49 of the device 30 close off the pail and device from below the ports 91. The closed environment below the ports 91 and the radially uniform air intake 100 prevent or substantially inhibit the air flow 102 from extending down into or below the top 5 of the pail 2. The lower level 106 of the dust shield zone 105 inside the device 30 is at a level proximal the suction ports 91. The air flow path of travel 102 for the suction ports 91 and hooded vents 92 extend inward and bend upward and outward as shown in FIG. 3. Thus, the air flow paths 102 for the spaced suction ports 91 generate a substantially uniform inward and upward and then outward pattern of airflow 103 around the circumference of the pail sidewall 4 and device centerlines 9 and 39 as best shown in FIG. 1B.

The uniform pattern of airflow 103 generates an air intake zone or airborne dust consumption zone 109 over and around the top of the device 30 from which airborne dust 22 is drawn into the device. Airborne dust 22 generated in or otherwise entering the air intake zone or region 109 flows into the suction ports 91. The dust shield 105 is within the air intake zone 109. The dust shield zone 105 has a thickness or height as shown in FIG. 1B. Inside 38 the device 30, the lower level 106 of the dust shield 105 is proximal to and about one inch below the bottom of the intake ports 91, which is well above the rim 5 of the pail 2. Outside the device 30, the lower level 107 of the dust shield 105 is generally even with the top 35 of the device 30. The dust shield zone 105 extends upwardly to an upper level 108 about one half to one foot above the top 35 of the device 30. Lighter airborne dust 22 generated in or otherwise flowing into the dust shield region 105 within the intake zone 109 is reliably drawn by the air flow 102 into the suction ports 91. Denser and heavier flows 11 of material 10 and dust 22 as well as denser flows of water 12 are not adversely affected by the air flow 102, and pour or pass through the dust shield 105 and air intake 109 zones and into the mixing pail 2 as shown in FIG. 1B. Dust 20 below the lower level 106 of the dust shield zone 105 inside the device 30 is not drawn into the ports 91 by the air flow and is allowed to settle on the surface 14 of the material and water mixture 10 and 12.

Figure 6:
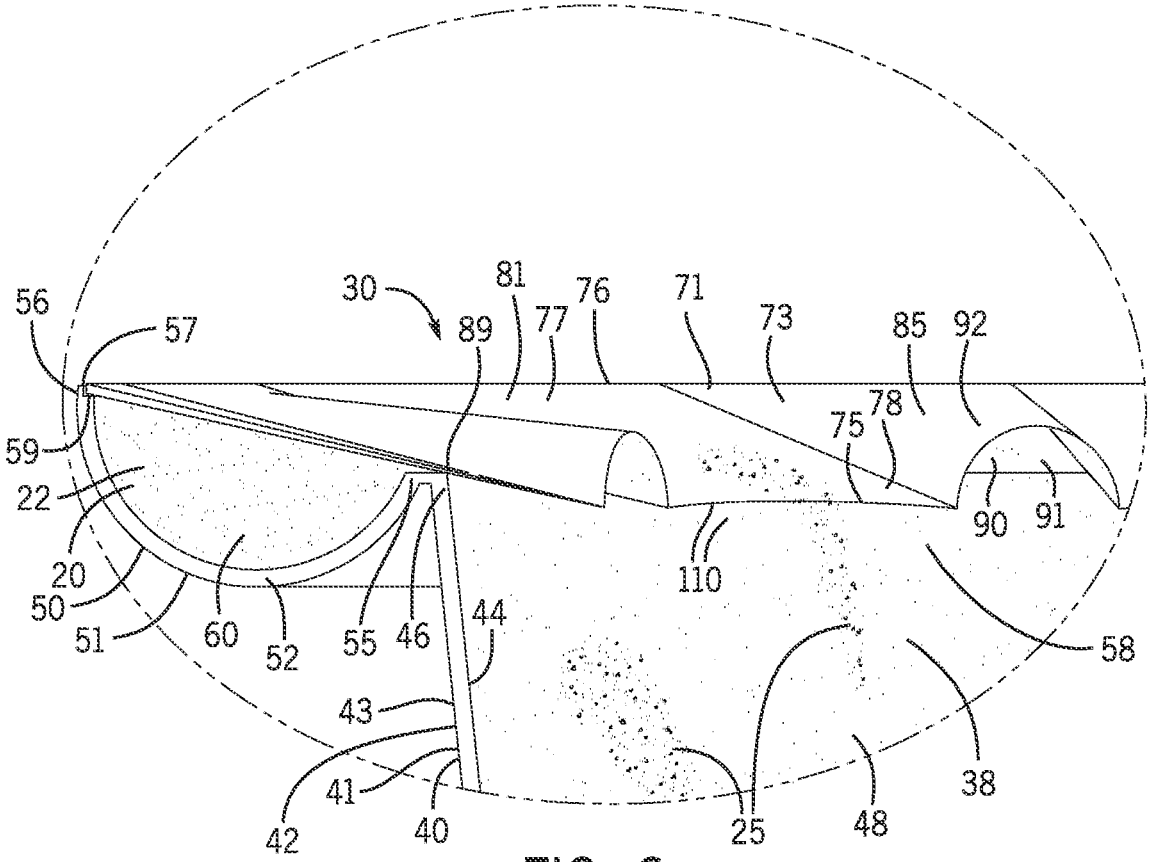
FIG. 6 is an enlarged sectional view showing the base, manifold housing and lid of the device, and showing splashes of material around the baffle and on the lid, with dust inside the central opening being vented through the arched vents and suction ports and into the radial chamber of the device.

The base wall 42 and inner radial portion 78 of the lid 71 form a splash baffle 110 that prevents splashes 25 from escaping the mixing container 2 as shown in FIGS. 5 and 6. The baffle 110 extends 360 degrees around the top of the device 30 and is located above the pail rim 5. The radial baffle 110 has a generally L-shaped configuration formed by the inner base wall surface 44 and the lower lid surface 74 of inner lid portion 78. Splashes 25 that strike the base wall surface 44 or inwardly extending lip surface 74 are redirected back into the mixing container 2. Splashes 25 that are propelled virtually straight up, and thus do not strike the baffle 110, either fall by gravity back into the pail 2 or land on the top surface 73 of the funnel-shaped manifold lid 71 and flow back into the container 2.

Operation of the Dust Shield and Splash Guard Device

Although the operation of the dust shield and splash guard device 30 should be readily understood based on the above, the following is provided for the convenience of the reader. To minimize dust 20 and splatter 25, all or most of the water 12 is first poured into the mixing pail 2. Either before or after the water is poured into the pail 2, the device 30 is inserted into and over the pail 2 until the base wall 42 engages and seals 49 against the pail wall 4 as in FIG. 1A. After connecting the vacuum hose 18 to the discharge nozzle 62 of the device 30 and activating the vacuum 17, the device 30 generates a uniform radial air intake 100 formed by the air flow paths of travel 102 into its radially distributed air intake 90 or suction ports 91 as shown in FIG. 2. As the air flow paths 102 bend upward as in FIG. 3, the uniform radial air intake 100 forms the dust shield 105 and air intake zone 109 above the device 30. The dust shield 105 extends upward inside the air intake zone 109 to a height of about one half to one foot above the device as in FIG. 1B. The lower pressure or suction inside the manifold channel 60, relative to the pressure of the surrounding air, pulls down the manifold lid 71 to seal 59 and 89 the lid against the manifold housing 51.

Figure 1B:
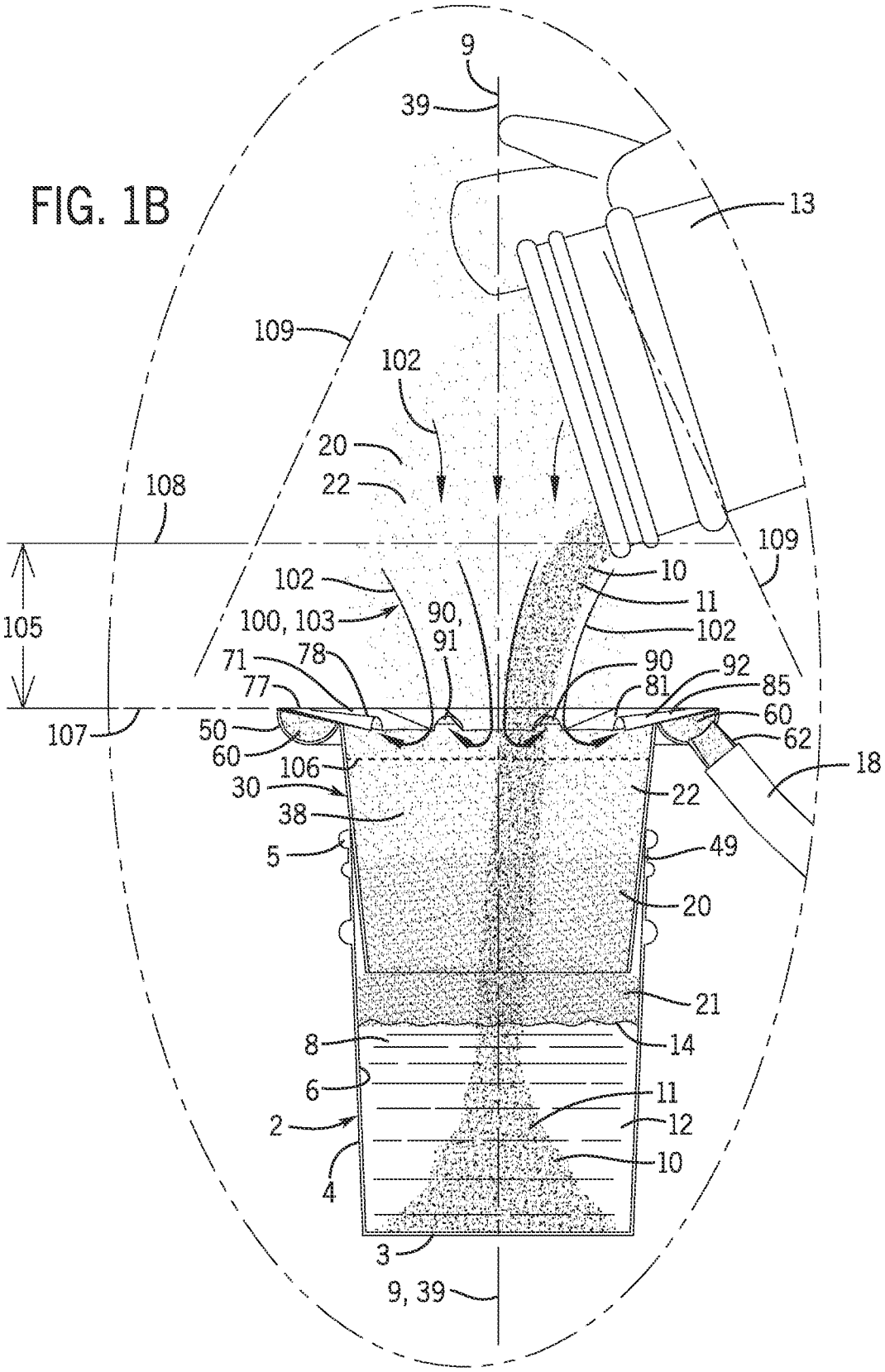
FIG. 1B is an exploded view showing the dust reduction and splash guard device capturing dust generated in a dust intake zone above the device, particularly dust below a dust shield line.

Powdery material 10 is then poured into the pail 2 as in FIGS. 1A and 1B. The container 13 of powdery material 10 is brought over and just above the top of the device 30 and tilted to pour out the material. The dense flow 11 of material 10 pours through the air shield and intake zones 105 and 109, past the air intake 90 and suction ports 91, through the interior 38 of the device 30, and into the water 12 inside 8 the pail 2 or accumulates on the surface 14 of the mixture. The inner disc-shaped radial lip 78 shields the air intake 90 and suction ports 91 from the downward flow 11 of material 10 or water 12. The radial shield 78 spaces the flows 11 of material 10 and water 12 from the air intake 90 and suction ports 91. The arched lid segments 85 forming the hooded vents 92 direct downward flows 11 of material 10 and water 12 to the sides of the vents, so that they do not flow directly in front of the suction ports 91 or vents 92. Denser flows 11 of material 10 or water 12 that might enter the bottomless vents 92 fall by gravity into the mixing pail 2. Still, the suction ports 91 and vents 92 capture the lighter airborne dust 22 that would otherwise escape into the surrounding air.

The device 30 captures the airborne dust 22 forming above the suction ports 91 within the intake or airborne dust consumption zone 109, particularly below the upper level 108 of the dust shield 105. The device 30 also captures dust 20, 22 propelled or rising up from inside 8 the pail 2 to a level at or near the ports 91. Thicker and denser or heavier dust 21 inside 8 the pail 2 is allowed to settle onto the surface 14 of the material 10 and water 12 mixture. Lighter airborne dust 22 is captured by the device 30 and sent to the vacuum 17 and air filter 19*a* to remove the dust from the air.

During mixing, paddles 16 are inserted through the open interior 38 of the device 30. The paddles 16 thoroughly mix the material 10 and water 12 together to form the desired building material as in FIGS. 4-6. The mixing process generates more dust 20, as well as splashes 25 of material 10 and water 12. Again, the device 30 captures the dust 20 rising up from the pail 2 near the level of the suction ports 91. The device 30 also retains the splashes 25 that strike or land on its base wall 42, lid 71 or radial splash guard 110. During mixing, additional water 12 or material 10 is poured through the device 30 and into the mixing pail 2 to achieve the desired consistency of the construction material. The device is then lifted off the pail 2 and set aside for further use or cleaning. The device 30 and its internal channel 60 are easily cleaned by removing its lid 71 and washing them down with water.

While the invention has been described with reference to a preferred embodiment, it will be understood by those skilled in the art that various changes may be made and equivalents may be substituted without departing from the broader aspects of the invention. For example, while the preferred embodiment shows the base, manifold housing and lid with certain diameters and lengths to accommodate common mixing pails, the device can be made in a variety of sizes, such as large, medium and small, to accommodate containers of varying sizes. In addition, although the preferred embodiment shows a radially disbursed air intake 90 formed by eight uniformly disbursed suction ports 91, the number and dispersion pattern of the ports can vary provided they generate a generally radially uniform air intake 100. It is presently believed there should be at least about four ports to generate an adequate dust shield 105 and airborne dust consumption 109 zones. The number of ports 91 can vary depending on a variety of factors, such as the size of the pail 2 and device 30 (e.g., large medium or small), the size of the ports, the type and consistency of powdery material 10 and the strength of the vacuum 17. For embodiments with more than eight ports 91, the size of the ports can decrease. To generate a uniform volumetric air intake 100 around the ring manifold 50, the size of the ports 91 can increase the further the port is from the exit nozzle 62.

I claim:

1. A dust shield device for use with a mixing pail and a suction generating apparatus when pouring and mixing a powdery material such as plaster, grout, cement or the like, the pail having a tubular pail sidewall, open pail interior, open upper pail end and central pail axis, the pail being within surrounding air, the powdery material generating dust when poured through the air as a flow of powdery material and when mixed with a liquid solvent such as water inside the pail, the suction generating apparatus having a suction hose, and said device comprising:

a mounting sleeve to selectively secure said device to the pail sidewall, said mounting sleeve having lower and upper open sleeve ends, an open sleeve interior and a central sleeve axis, said sleeve being adapted to snuggly engage the pail sidewall, said central sleeve axis being colinear with the central pail axis;

a radial manifold with a manifold housing, a manifold lid, a plurality of suction ports, an enclosed radial channel pneumatically joining said suction ports with a discharge nozzle, an open manifold interior and a central manifold axis, said radial manifold being joined proximal said upper open sleeve end and extending around said mounting sleeve, said mounting sleeve positioning said radial manifold over the open upper pail end with said central manifold axis being colinear with said central sleeve axis, said suction ports being located at spaced locations around said radial manifold, said manifold housing having an inner manifold perimeter, said manifold lid having an inner lid portion extending inwardly from said inner manifold perimeter toward said central sleeve axis, said discharge nozzle being adapted to selectively connect to the suction hose to pneumatically join the radial channel to the suction generating apparatus; and, wherein the suction generating device is selectively operable to provide suction to said radial channel and said suction ports to generate a radially uniform dust shield zone, said dust shield zone extending radially around said device from a first level proximal said ports to a second level above said device, and wherein the flow of powdery material flows through said dust shield zone and into the open pail interior, and said suction ports draw in the dust within said dust shield zone when pouring and mixing the powdery material.

2. The dust shield device of claim 1, and wherein said inner lid portion forms a radial guard extending over said suction ports to space said suction ports from the flow of powdery material.

3. The dust shield device of claim 2, and wherein said mounting sleeve has a base wall, and said base wall and said radial guard form a radial splash guard to retain splashes of the material and water inside the mixing pail when mixing the material and water in the pail.

4. The dust shield device of claim 2, and wherein said enclosed radial channel has a top, a bottom and side surfaces, said manifold housing forms said bottom and side surfaces of said radial channel, and said manifold lid forms said top surface of said radial channel.

5. The dust shield device of claim 4, and wherein said manifold housing has an outer manifold housing perimeter, said manifold lid has an outer lid portion, inner and outer lid perimeters and an arced lid support region, said outer manifold housing perimeter supportably engaging said outer lid perimeter, said inner manifold housing perimeter supportably engaging said arced lid support region, said outer lid portion forming said top of said enclosed radial channel.

6. The dust shield device of claim 5, and wherein manifold lid is selectively separable from said manifold housing, said outer manifold housing perimeter engaging said outer lid perimeter to capture said manifold lid, said outer manifold perimeter sealingly engaging said outer lid perimeter when the vacuum provides suction to said radial channel, and said inner manifold housing perimeter engages said arced lid support region between said suction ports, said inner manifold housing perimeter sealingly engaging said arced lid support region between said suction ports when the vacuum provides suction to said radial channel.

7. The dust shield device of claim 2, and wherein said lid is a funnel shaped lid.

8. The dust shield device of claim 1, and wherein each said suction port has a hooded intake vent.

9. The dust shield device of claim 8, and wherein said hooded intake vents are bottomless.

10. The dust shield device of claim 1, and wherein said device has a circumference, and said suction ports draw in dust from an air intake zone extending around said circumference of said device, and said dust shield zone extends upward from said device at least about one half foot and is within said air intake zone.

11. The dust shield device of claim 1, and wherein said dust generated by said flow of powdery material and said mixing of the powdery material includes airborne dust, and said airborne dust is drawn into said suction ports.

12. The dust shield device of claim 11, and wherein said dust generated by said flow of powdery material and said mixing of the powdery material includes heavier dust, and wherein the heavier dust passes through said dust shield zone and settles inside the mixing pail.

13. The dust shield device of claim 1, and wherein the tubular pail sidewall has a circumference, and said radial manifold and said radial channel extend completely around the circumference of the tubular pail sidewall.

14. The dust shield device of claim 1, and wherein said suction ports are arranged in a uniform disbursement around said manifold housing, said uniform disbursement includes at least about four of said suction ports.

15. The dust shield device of claim 14, and wherein there are eight of said suction ports spaced at 45 degree increments around said manifold, each of said ports has a uniform size, and each of said ports faces inwardly toward said open manifold interior.

16. The dust shield device of claim 1, and wherein the mixing pail has a pail height, and said mounting sleeve extends upwardly from the upper open pail end to extend the pail height and positions said radial manifold above the upper open pail end.

17. The dust shield device of claim 1, and wherein said dust shield device has a weight, the pail sidewall has an inside surface and said mounting sleeve has an outer sleeve surface, and said outer sleeve surface is adapted for pressed engagement with the inside surface of the pail sidewall, and the pail sidewall carries said weight of said dust shield device.

18. The dust shield device of claim 17, and wherein said mounting sleeve sealingly engages the pail sidewall.

19. The dust shield device of claim 18, and wherein the upper pail end has an upper pail diameter, and said mounding sleeve is a frustoconical sleeve tapering from said upper sleeve end toward said lower sleeve end, said lower sleeve end has a lower sleeve diameter, said upper sleeve end has an upper sleeve diameter, said lower sleeve diameter is smaller than the upper pail diameter, and said upper sleeve diameter is larger than the upper pail diameter.

20. The dust shield device of claim 1, and wherein the suction generating device has an associated air filter, and wherein the dust drawn in by said suction ports is filtered by the air filter before being discharged to the surrounding air.

21. A dust shield device for use with a mixing pail and a suction generating apparatus when pouring and mixing a powdery material such as plaster, grout, cement or the like, the pail having a tubular pail sidewall, open pail interior, open upper pail end and central pail axis, the pail being within surrounding air, the powdery material generating dust when poured through the air as a flow of powdery material and when mixed with a liquid solvent such as water inside the pail, the suction generating apparatus having a suction hose, and said device comprising:

a mounting sleeve to selectively secure said device to the pail sidewall, said mounting sleeve having lower and upper open sleeve ends, an open sleeve interior and a central sleeve axis, said sleeve being adapted to snuggly engage the pail sidewall, said central sleeve axis being colinear with the central pail axis;

a radial manifold with a manifold housing, a manifold lid, an enclosed radial channel pneumatically joining a radially disbursed air intake with a discharge nozzle, an open manifold interior and a central manifold axis, said radial manifold being joined proximal said upper open sleeve end and extending around said mounting sleeve, said mounting sleeve positioning said radial manifold over the open upper pail end with said central manifold axis being colinear with said central sleeve axis, said radially disbursed air intake being circumferentially located around said radial manifold, said manifold housing having an inner manifold perimeter, said manifold lid having an inner lid portion extending inwardly from said inner manifold perimeter toward said central sleeve axis, said discharge nozzle being adapted to selectively connect to the suction hose to pneumatically join the radial channel to the suction generating apparatus; and, wherein the suction generating device is selectively operable to provide suction to said radial channel and said radially disbursed air intake to generate a radially uniform dust shield zone, said dust shield zone extending radially around said device from a first level proximal said disbursed air intake to a second level above said device, and wherein the flow of powdery material flows through said dust shield zone and into the open pail interior, and said disbursed air intake draws in the dust within said dust shield zone when pouring and mixing the powdery material.

22. The dust shield device of claim 21, and wherein the radially disbursed air intake is formed by a plurality of spaced suction ports.

* * * * *